US009266349B2

(12) United States Patent
Nishihara

(10) Patent No.: US 9,266,349 B2
(45) Date of Patent: Feb. 23, 2016

(54) COLOR PRINTER AND METHOD FOR CONTROLLING HEAT PULSE OF COLOR PRINTER

(71) Applicant: Brother Kogyo Kabushiki Kaisha, Nagoya-shi, Aichi-ken (JP)

(72) Inventor: Keisuke Nishihara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/490,187

(22) Filed: Sep. 18, 2014

(65) Prior Publication Data

US 2015/0085053 A1 Mar. 26, 2015

(30) Foreign Application Priority Data

Sep. 20, 2013 (JP) ..... 2013-195308

(51) Int. Cl.
*B41J 2/325* (2006.01)
*B41J 2/36* (2006.01)

(52) U.S. Cl.
CPC ..... *B41J 2/36* (2013.01)

(58) Field of Classification Search
None
See application file for complete search history.

(56) References Cited

U.S. PATENT DOCUMENTS

| | | | | |
|---|---|---|---|---|
| 4,772,874 | A | 9/1988 | Hasegawa | |
| 2013/0021421 | A1* | 1/2013 | Ishikawa et al. | 347/172 |
| 2013/0033555 | A1* | 2/2013 | Matsutani | 347/211 |

FOREIGN PATENT DOCUMENTS

| | | | |
|---|---|---|---|
| JP | S60181815 | A | 9/1985 |
| JP | H05-16413 | A | 1/1993 |
| JP | H05-069579 | A | 3/1993 |
| JP | H07-109572 | B2 | 11/1995 |
| JP | 2000-190548 | A | 7/2000 |
| JP | 2008-229855 | A | 10/2008 |
| JP | 2012-076351 | A | 4/2012 |

* cited by examiner

*Primary Examiner* — Geoffrey Mruk
*Assistant Examiner* — Bradley Thies
(74) *Attorney, Agent, or Firm* — Banner & Witcoff, Ltd.

(57) ABSTRACT

When a color development heat pulse set for each one dot of an intended image is applied to a coloring heat element associated with the one dot of the intended image in a thermal head, an auxiliary heat pulse set for development of the intended image at a thermosensitive medium is applied to a non-printing heat element that adjoins to the coloring heat element associated with the one dot of the intended image with reference to a scanning direction of the thermal head, the auxiliary heat pulse being not so hot for color development at the color thermo sensitive medium.

13 Claims, 10 Drawing Sheets

AUXILIARY HEAT PULSE TABLE

HIGH PRIORITY ↑ ↓ LOW PRIORITY

| TO-BE-PRODUCED COLOR AT ADJOINING DOT | AUXILIARY HEAT PULSE |
|---|---|
| GET Y COLORING LAYER DEVELOPED FOR PRODUCING Y | 20/160*32 |
| GET M & Y COLORING LAYERS DEVELOPED FOR PRODUCING R | 20/200*25 |
| GET NO COLORING LAYERS DEVELOPED FOR PRODUCING W | 20/240*21 |
| GET C & M & Y COLORING LAYERS DEVELOPED FOR PRODUCING Bk | 20/320*10 |
| GET C & M COLORING LAYERS DEVELOPED FOR PRODUCING B | 20/320*4 |

FIG. 6

COLOR DEVELOPMENT HEAT PULSE TABLE

| | No | Y | R | B | Bk&W |
|---|---|---|---|---|---|
| LIGHT ↑ | 1 | 80+ 20/150*30 | 150+ 30/110*35 | 800 | |
| | 2 | 100+ 20/150*34 | 180+ 30/110*40 | 900 | |
| | 3 | 120+ 20/150*38 | 210+ 30/110*45 | 1000 | REFER TO AUXILIARY HEAT PULSE TABLE |
| ↓ DARK | 4 | 140+ 20/150*42 | 240+ 30/110*50 | 1100 | 500+ 40/80*40 |

FIG. 7

AUXILIARY HEAT PULSE TABLE

| | TO-BE-PRODUCED COLOR AT ADJOINING DOT | AUXILIARY HEAT PULSE |
|---|---|---|
| HIGH PRIORITY ↑ | GET Y COLORING LAYER DEVELOPED FOR PRODUCING Y | 20/160*32 |
| | GET M & Y COLORING LAYERS DEVELOPED FOR PRODUCING R | 20/200*25 |
| | GET NO COLORING LAYERS DEVELOPED FOR PRODUCING W | 20/240*21 |
| | GET C & M & Y COLORING LAYERS DEVELOPED FOR PRODUCING Bk | 20/320*10 |
| ↓ LOW PRIORITY | GET C & M COLORING LAYERS DEVELOPED FOR PRODUCING B | 20/320*4 |

COLOR PRINTER AND METHOD FOR CONTROLLING HEAT PULSE OF COLOR PRINTER

CROSS-REFERENCE TO RELATED APPLICATIONS

The present application claims priority from Japanese Patent Application No. JP 2013-195308, which was filed on Sep. 20, 2013, the disclosure of which is incorporated herein by reference in its entirety.

TECHNICAL FIELD

The disclosure relates to a color printer configured to perform color print by getting a thermosensitive medium through a thermal head only once (termed as one-pass operation, hereinafter), and a method for controlling heat pulse of a color printer.

BACKGROUND

Since establishment the conventional technique relating to one-pass operation for color print performed with a color printer and a method for controlling heat pulse of a color printer, respective heat elements constituting a thermal head have been distinguished between coloring heat elements which are to perform color print at a printing medium and non-printing heat elements which are not to perform color print thereat. Incidentally, in a conventional printer disclosed in JP Laid-open patent application publication No. 2012-76351, at the time of performing color print with a thermal head, color development heat is applied to coloring heat elements of the thermal head while auxiliary heat (not so hot for color printing at a printing medium) is applied to either non-printing heat elements or coloring heat elements depending on print speed.

The above conventional printer is configured to perform black-and-white print on a thermo sensitive medium and perform color print on a printing medium by transferring color of a colored ink ribbon to the printing medium. That is, one-pass operation disclosed in the above-specified publication is applicable to a printer which is configured to perform one-colored print by using the thermal head. Accordingly, the print technique of the printer disclosed in the above publication is not applicable to a color printer which performs multicolor print on a color thermosensitive medium as printing medium in one-pass operation by using a thermal head as well as a method for controlling heat pulse of the color printer.

Further, in the color printer and the method for controlling heat pulse of the color printer, a pattern of color development heat to be applied to coloring heat elements of the thermal head is made different for each color to be printed at a color thermosensitive medium as printing medium at the time of performing multicolor print with the thermal head in one-pass operation. Therefore, it is not preferable to apply auxiliary heat to some of or all of the non-printing heat elements of the thermal head at constant pattern regardless of colors to be printed on a color thermosensitive medium at the time of performing multicolor print by using the thermal head in one-pass operation.

SUMMARY

The disclosure has been made to solve the above-described problem and has an object to provide a color printer and a method for controlling heat pulse of a color printer capable of improving color development properties when performing multicolor print on a color thermosensitive medium as printing medium by using a thermal head in one-pass operation.

To achieve the purpose of the disclosure, there is provided a color printer which is configured to perform color print by getting a color thermosensitive medium through a thermal head which consists of plural heat elements only once for color development at the color thermosensitive medium, wherein the color thermosensitive medium includes a base material and two or more of coloring layers laminated on the base material so that a topmost one of the coloring layers is put closest and the base material is put farthest with reference to the thermal head when the color thermosensitive medium is conveyed for multicolor print, wherein color development temperature is different by each of the two or more of coloring layers laminated on the base material, wherein, as lamination position gets closer to the base material among the two or more of coloring layers, color development temperature of a coloring layer at the lamination position is set lower and heat duration required for color development of a coloring layer at the lamination position is set longer, wherein, when getting color development at the color thermosensitive medium, all the plural heat elements of the thermal head are distinguished between coloring heat elements for performing color development at the color thermosensitive medium and non-printing heat elements for withholding color development at the color thermo sensitive medium, and wherein, when a color development heat pulse set for each one dot of an intended image is applied to a coloring heat element associated with the one dot of the intended image in the thermal head, an auxiliary heat pulse set for development of the intended image at the color thermo sensitive medium is applied to a non-printing heat element that adjoins to the coloring heat element associated with the one dot of the intended image with reference to a scanning direction of the thermal head.

Furthermore, according to another aspect, there is provided a method for controlling heat pulse of a color printer which is configured to perform color print by getting a color thermosensitive medium through a thermal head which consists of plural heat elements only once for color development at the color thermosensitive medium, wherein the color thermosensitive medium includes a base material and two or more of coloring layers laminated on the base material so that a topmost one of the coloring layers is put closest and the base material is put farthest with reference to the thermal head when the color thermosensitive medium is conveyed for multicolor print, wherein color development temperature is different by each of the two or more of coloring layers laminated on the base material, wherein, as lamination position gets closer to the base material among the two or more of coloring layers, color development temperature of a coloring layer at the lamination position is set lower and heat duration required for color development of a coloring layer at the lamination position is set longer, wherein, when getting color development at the color thermosensitive medium, all the plural heat elements of the thermal head are distinguished between coloring heat elements for performing color development at the color thermosensitive medium and non-printing heat elements for withholding color development at the color thermosensitive medium, and wherein, when a color development heat pulse set for each one dot of an intended image is applied to a coloring heat element associated with the one dot of the intended image in the thermal head, an auxiliary heat pulse set for development of the intended image at the color thermosensitive medium is applied to a non-printing heat element that adjoins to the coloring heat element associated with the one dot of the intended image with reference to a scanning direction of the thermal head.

BRIEF DESCRIPTION OF THE DRAWINGS

FIG. 6 is a color development heat pulse table set for the color printer;

FIG. 7 is an auxiliary heat pulse table set for the color printer;

DETAILED DESCRIPTION

There will be given a detailed description of an exemplary embodiment of a color printer and a method for controlling heat pulse of a color printer embodying the disclosure by referring to the accompanying drawings.

1. First Embodiment

Firstly, there will be described on a color printer 101 and a method for controlling heat pulse of the color printer 101 directed to the first embodiment.

1-1. Color Printer

Figure 1:
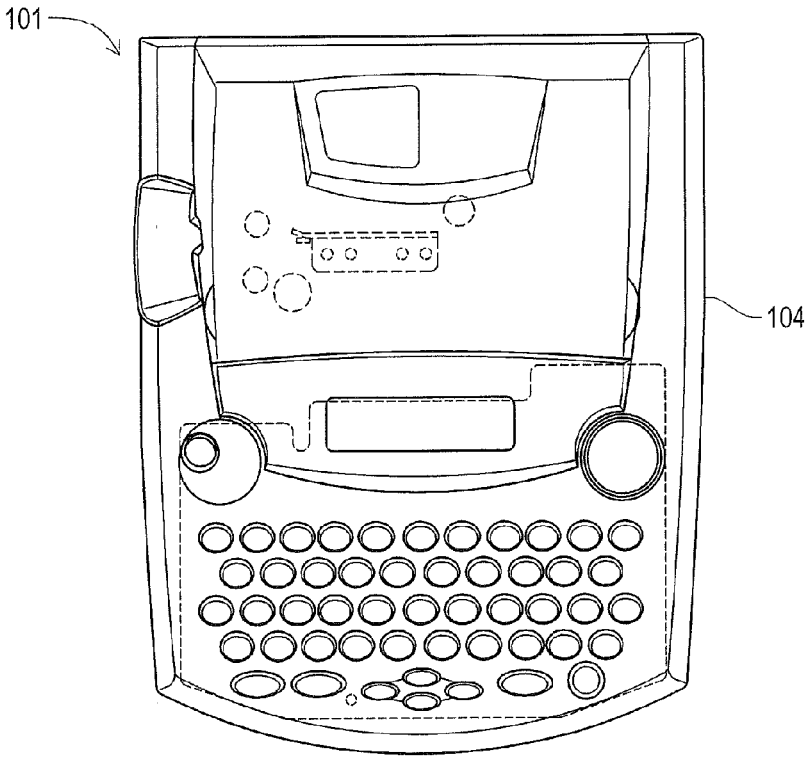
FIG. 1 is a top view of a color printer common to a first embodiment and a second embodiment of the disclosure.
Figure 2:
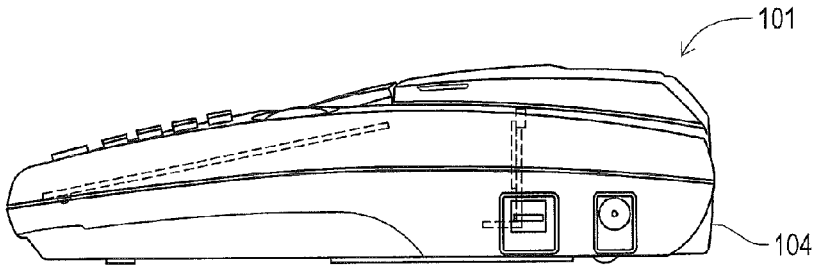
FIG. 2 is a side view of the color printer.
Figure 3:
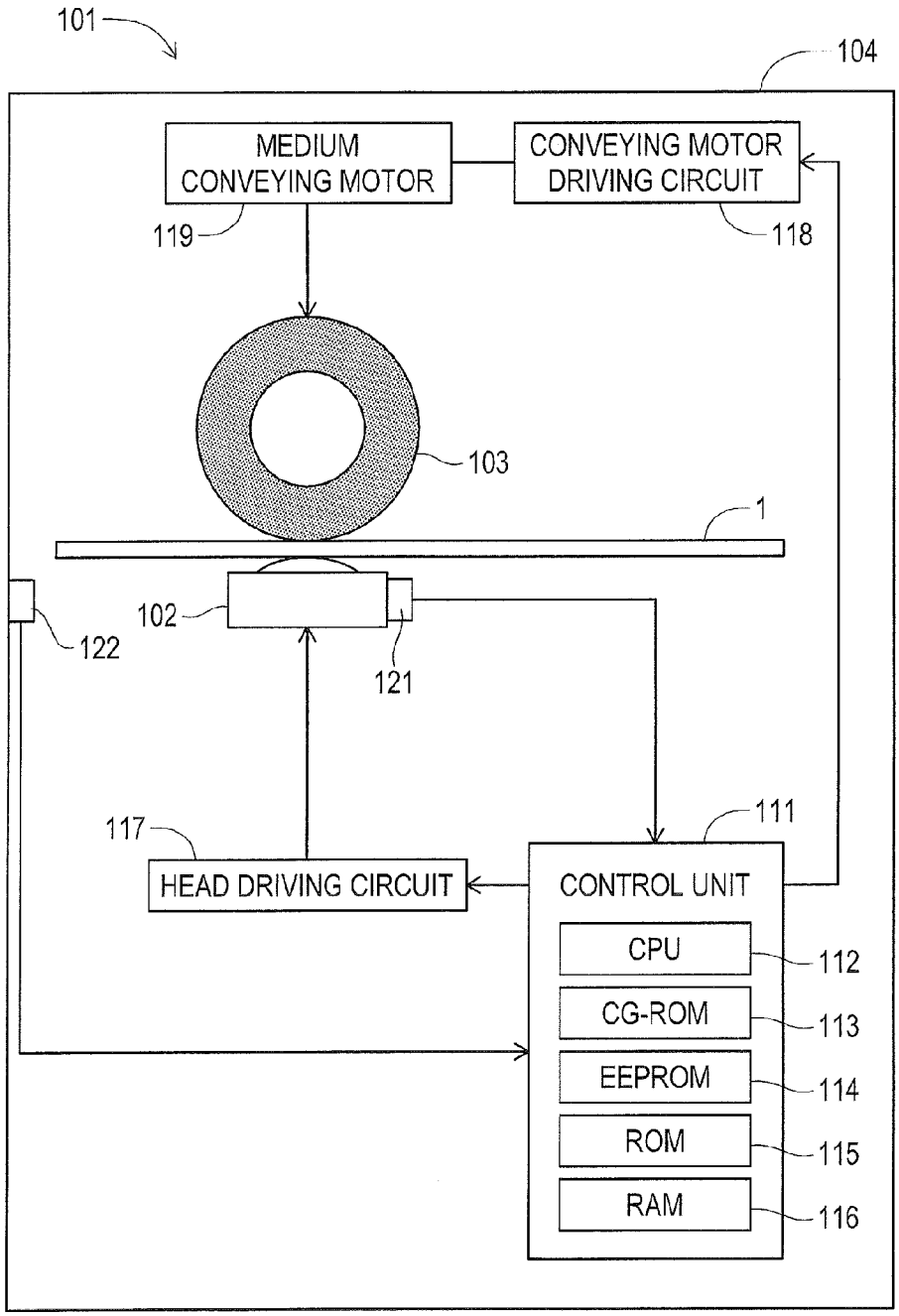
FIG. 3 is a block diagram of the color printer.

Here will be described on the color printer 101 directed to the first embodiment by referring to FIG. 1 through FIG. 4. The color printer 101 has a main body 104 as illustrated in FIG. 1 and FIG. 2. As illustrated in FIG. 3, the color printer 101 directed to the first embodiment includes a thermal head 102, a platen roller 103, a control unit 111, a head driving circuit 117, a conveying motor driving circuit 118, a medium conveying motor 119, a thermistor 121 and a temperature measuring device 122.

The thermistor 121 is mounted on the thermal head 102 so as to detect temperature of the thermal head 102. The temperature measuring device 122 is installed near the thermal head 102 in the main body 104 so as to detect temperature of the atmosphere near the thermal head 102. A color thermosensitive medium 1 is held between the thermal head 102 and the platen roller 103, and conveyed by the rotation of the platen roller 103 in only one direction at the time of multicolor print. That is, the color printer 101 directed to the first embodiment performs multicolor print in one-pass operation (in which the color thermosensitive medium 1 is conveyed in one direction only once).

The control unit 111 includes a CPU 112, a CG-ROM 113, an EEPROM 114, a ROM 115 and a RAM 116.

The CPU 112 is a central processing unit that is the nucleus of various controls in the color printer 101 directed to the first embodiment. Accordingly, the CPU 112 controls the color printer 101 itself based on various control programs. The CG-ROM 113 is character generator memory in which image data of a character or symbol to be printed is related to code data and stored in the form of a dot pattern. The EEPROM 114 is non-volatile memory that allows writing and erasing of stored contents. The ROM 115 stores various control programs and data used at the color printer 101 directed to the first embodiment. The RAM 116 temporarily stores a computation result by the CPU 112, or the like. The RAM 116 further stores data such as edited print data.

The control unit 111 is coupled to the head driving circuit 117 and the conveying motor driving circuit 118. The head driving circuit 117 is a circuit that supplies the thermal head 102 with a drive signal based on a control signal from the CPU 112 and controls the driving state of the thermal head 102. The conveying motor driving circuit 118 is a circuit that supplies the medium conveying motor 119 with a drive signal based on a control signal from the CPU 112 and controls the rotation of the platen roller 103 through the drive control of the medium conveying motor 119.

Figure 4:
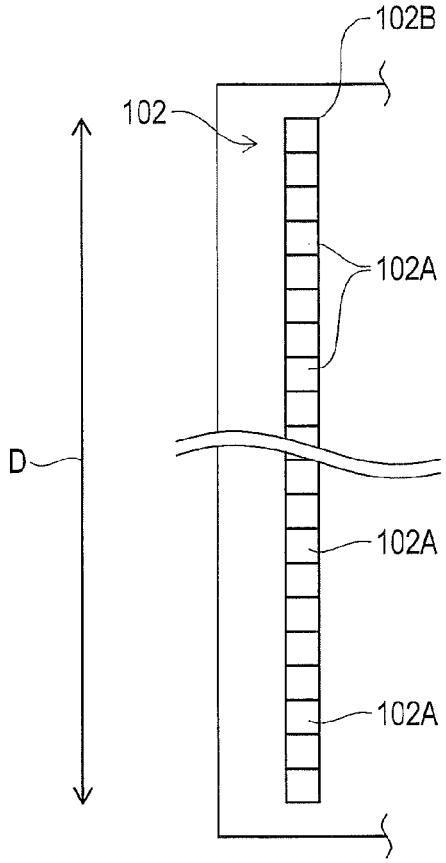
FIG. 4 is an enlarged view of a thermal head for the color printer.

When being conveyed in one direction by the rotation of the platen roller 103 for multicolor print, the color thermosensitive medium 1 held between the thermal head 102 and the platen roller 103 is pressed against the thermal head 102 by the platen roller 103. As illustrated in FIG. 4, the thermal head 102 includes a line head 102B on which plural heat elements 102A (five hundred and forty, in the embodiment) arranged in a row in a main scanning direction D which coincides with the width direction of the color thermosensitive medium 1.

1-2. Color Thermosensitive Medium

Figure 5:
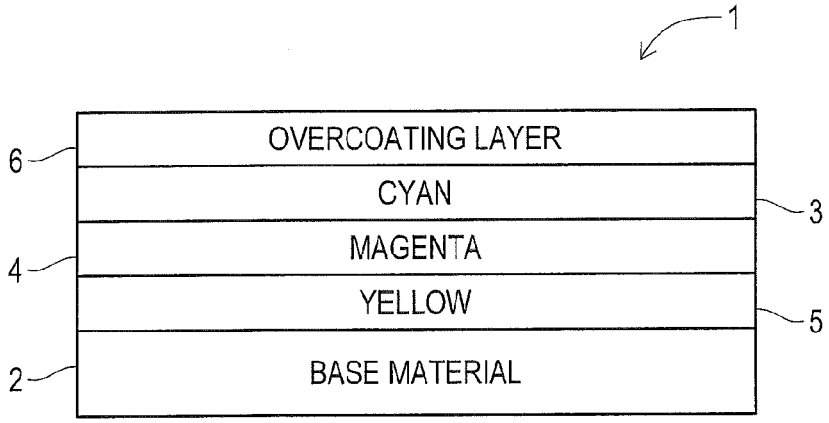
FIG. 5 is a cross-sectional view of a color thermosensitive medium used by the color printer directed to the first embodiment.

As illustrated in FIG. 5, the color thermo sensitive medium 1 directed to the first embodiment includes a white-colored base material 2. On the base material 2, yellow, magenta and cyan coloring layers 5, 4, 3 are laminated in this order. An overcoating layer 6 is laminated on the cyan coloring layer 3.

At the time of multicolor print, the color thermosensitive medium 1 is conveyed in only one direction by the platen roller 103 in a state of being held between the thermal head 102 and the platen roller 103. While being conveyed in the state of being held between the thermal head 102 and the platen roller 103, the color thermosensitive medium 1 is pressed against the thermal head 102 by the platen roller 103.

Of the color thermosensitive medium 1, the side of the overcoating layer 6 laid over the cyan coloring layer 3 is pressed against the thermal head 102. That is, when seen from the side of the thermal head 102 in contact with the color thermosensitive medium 1 at the time of conveying the color thermosensitive medium 1, the cyan coloring layer 3, the magenta coloring layer 4, the yellow coloring layer 5 and the base material 2 are put even farther therefrom in this order.

The thermal head 102 generates color development heat which is heat energy for color development at the color thermosensitive medium 1. The thermal head 102 also generates auxiliary heat which is heat energy not so hot as the extent of causing color development at the color thermosensitive medium 1.

As already described, of the color thermosensitive medium 1, the overcoating layer 6 laid over the cyan coloring layer 3 is pressed against the thermal head 102. Therefore, heat energy (color development heat and auxiliary heat) generated by the thermal head 102 is given to the color thermosensitive medium 1 from the side of the overcoating layer 6 laminated over the cyan coloring layer 3.

At the time of multicolor print, the control unit 111 and the head driving circuit 117 control the thermal head 102 for proper color development at the color thermosensitive medium 1 in accordance with respective color development properties of the cyan, magenta and yellow coloring layers 3, 4 and 5.

The control unit 111 and the head driving circuit 117 control duration of drive voltage application to the thermal head 102 and drive voltage application timing in a print cycle (7000 μs, in the embodiment). Thereby, regarding each heat element 102A of the thermal head 102, a set of heat temperature and heat duration is controlled by selectively using two kinds of heat, namely, between color development heat and auxiliary heat depending on respective color development properties of the cyan, magenta and yellow coloring layers 3, 4 and 5 of which colors are to get developed at the color thermosensitive medium 1.

Incidentally, all the heat elements 102A of the thermal head 102 for multicolor print are functionally distinguished between "coloring heat elements" and "non-printing heat elements". More specifically, in the thermal head 102, the coloring heat elements are heat elements subject to receiving color development heat which is heat energy for color development at the color thermosensitive medium 1 while the non-printing heat elements are heat elements subject to receiving auxiliary heat. That is, auxiliary heat is given to a heat element 102A distinguished as a "non-printing heat element" which adjoins to a heat element 102A distinguished as a "coloring heat element", with reference to the main scanning direction D of the thermal head 102.

That is, depending on respective coloring properties of the cyan, magenta and yellow coloring layers 3, 4 and 5 which are to get developed at the color thermosensitive medium 1, the control unit 111 and the head driving circuit 117 selectively apply color development heat pulses to "coloring heat elements" among the heat elements 102A while applying auxiliary heat pulses to "non-printing heat elements" adjoining to "coloring heat elements" with reference to the main scanning direction D of the thermal head 102. Incidentally, hatching for distinctively indicating cross-sections of the base material 2, the cyan, magenta and yellow coloring layers 3, 4 and 5 and the overcoating layer 6 is omitted in FIG. 5 for the purpose of avoiding too many lines disturbing view of the color thermosensitive medium 1.

1-3. Color Development Properties of Color Thermosensitive Medium

As described in the above, each of the cyan, magenta and yellow coloring layers 3, 4 and 5 has its own color development properties. The cyan coloring layer 3 is an uppermost coloring layer facing the thermal head 102 when the color thermosensitive medium 1 is conveyed, so that cyan starts coloring up relatively in a shorter period of time at higher temperature. The yellow coloring layer 5 is a bottommost coloring layer farthest from the thermal head 102 when the color thermosensitive medium 1 is conveyed, so that yellow starts coloring up relatively in a longer period of time at lower temperature. The magenta coloring layer 4 is a middle coloring layer between the uppermost and bottommost coloring layers, so that magenta starts coloring up in a medial period of time at medial temperature in comparison with the top and bottom coloring layers.

That is, each of the cyan, magenta and yellow coloring layers 3, 4 and 5 has its own color development temperature. Color development temperature of the yellow coloring layer 5 put as bottommost coloring layer is lower than that of the magenta coloring layer 4 put as middle coloring layer. Color development temperature of the magenta coloring layer 4 is lower than that of the cyan coloring layer 3 put as uppermost coloring layer. For color development of the yellow coloring layer 5 as bottommost coloring layer, it is required that duration to heat the yellow coloring layer 5 be made longer than duration to heat the magenta coloring layer 4 as middle coloring layer. For color development of the magenta coloring layer 4 as middle coloring layer, it is required that duration to heat the magenta coloring layer 4 be made longer than duration to heat the cyan coloring layer 3 as the uppermost coloring layer.

In the first embodiment, five colors can get developed with the color thermosensitive medium 1 by combining coloring layers to get developed on the white-colored base material 2 from among three coloring layers, namely, the cyan, magenta and yellow coloring layers 3, 4 and 5. The five available colors are yellow (shortened as "Y", herein after), red (shortened as "R"), blue (shortened as "B"), white (shortened as "W") and black (shortened as "Bk"). "Y" is a single color that can color up from the yellow coloring layer 5. "R" is a synthetic color of the magenta coloring layer 4 and the yellow coloring layer 5. "B" is a synthetic color of cyan coloring layer 3 and the magenta coloring layer 4. "W" is a color obtained with getting developed none of the cyan coloring layer 3, the magenta coloring layer 4 and the yellow coloring layer 5. "Bk" is a synthetic color of the cyan coloring layer 3, the magenta coloring layer 4 and the yellow coloring layer 5.

As the color development heat pulse table of FIG. 6 shows, depending on color to get developed at the color thermosensitive medium 1, there are set variations with respect to value of color development heat pulse to be applied to a heat element 102A distinguished as "coloring heat element". Further, except for "W" and "Bk", there are set four color tone levels "1", "2", "3" and "4" for each of the other three colors "Y", "R" and B" so that those three colors can get developed at desired color tone on the color thermosensitive medium 1. Here will be described on how to read the color development heat pulse table shown in FIG. 6. For instance, as to "R" of color tone level "1" with indication of "150+30/110*35", the indication means that a main pulse is firstly applied for 150 μs and thereafter, ON-OFF switching of power supply (a chopper control) is carried out 35 times in a 110 μs-long cycle at 27% (=30/110) of duty cycle.

Further, the indication of "500+40/80*40" means that a color development heat pulse of "500+40/80*40" is applied to a heat element 102A distinguished as a "coloring heat element" for coloring up "Bk". For coloring of "W", application of a color development heat pulse to a "coloring heat element" is not performed; instead, there is performed application of an auxiliary heat pulse to an "non-printing heat element" which adjoins to the "coloring heat element" with reference to the main scanning direction D of the thermal head 102 in accordance with the auxiliary heat pulse table shown in FIG. 7.

As the auxiliary heat pulse table of FIG. 7 shows, depending on color to get developed at the color thermosensitive medium 1, there are set variations with respect to value of auxiliary heat pulse to be applied to an "non-printing heat element" which adjoins to the "coloring heat element" with reference to the main scanning direction D of the thermal head 102. Auxiliary heat temperature to be given to a heat element 102A distinguished as a "non-printing heat element" is set different depending on color; here, 60 degrees C. is set for "Y", 50 degrees C. for "R", 25 degrees C. for "B", 30 degrees C. for "Bk" and 45 degrees C. for "W".

Here will be described on how to read the auxiliary heat pulse table shown in FIG. 7. For instance, as to "R" with indication of "20/200*25", the indication means that ON-OFF switching of power supply (a chopper control) is carried out 25 times in a 200 μs-long cycle at 10% (=20/200) of duty cycle.

It is to be noted that a heat element 102A designated as "non-printing heat element" may be present so that both sides thereof should adjoin two heat elements 102A designated as "coloring heat elements" with reference to the main scanning direction D of the thermal head 102. In that case, different color development heat pulse may be given to the two "coloring heat elements" for development of different colors at the sides of the "non-printing heat element". In the case of developing different colors at both sides of the "non-printing heat element" (namely, at the color thermosensitive medium 1), an auxiliary heat pulse of higher priority ranking one between the two different colors is selected (refer to FIG. 12) in accordance with color selection priority order specified as "Y", "R", "W", "Bk" and "B" from high ranking.

Further, an auxiliary heat pulse of "20/240*21" is set for "W" and given to a heat element 102A distinguished as "non-printing heat element" in the thermal head 102 for coloring up of "W". The color development heat pulse table shown in FIG. 6 and the auxiliary heat pulse table shown in FIG. 7 are stored in the ROM 115.

1-4. Flow Chart of Print (Method for Controlling Heat Pulse)

Figure 8:
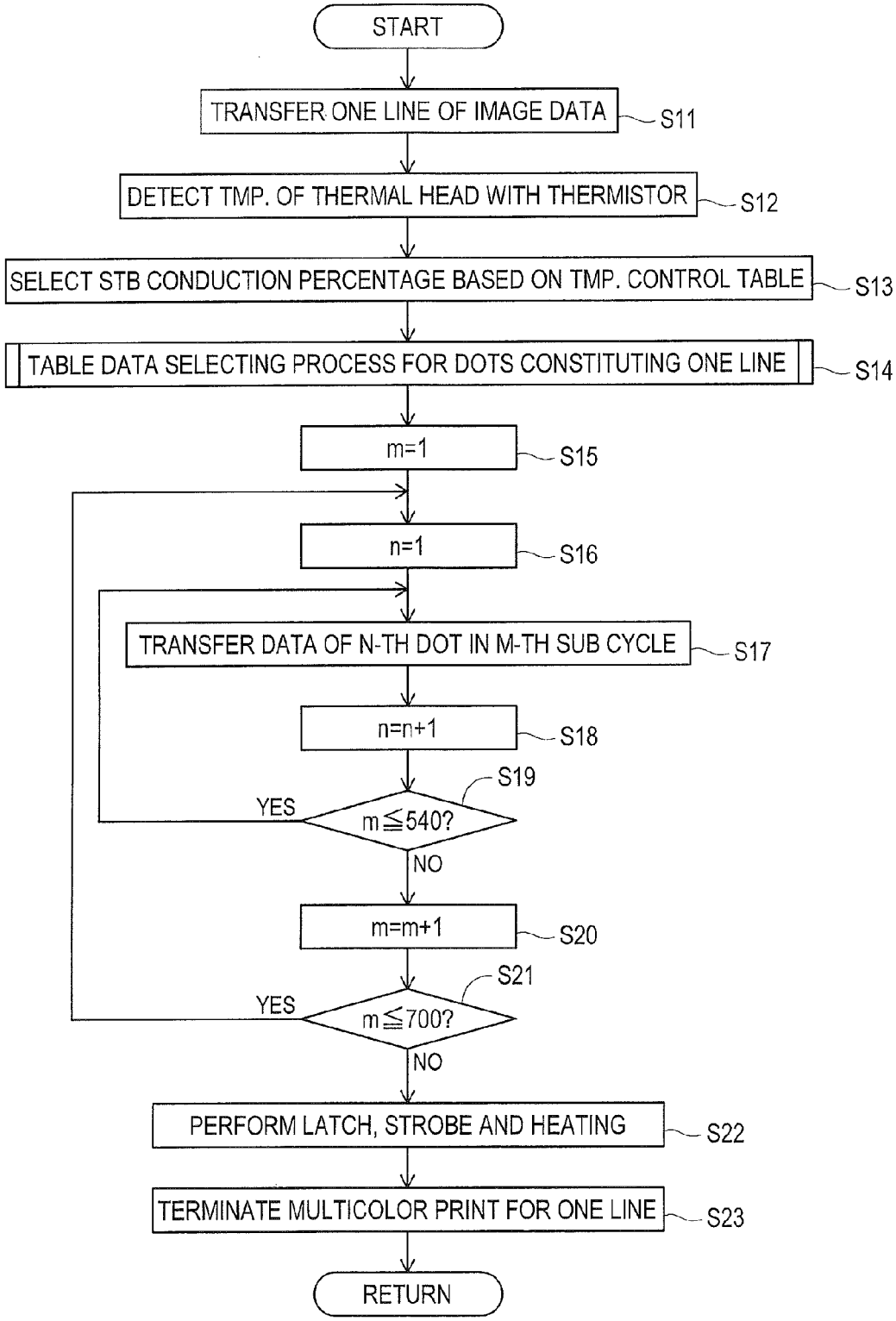
FIG. 8 is a flow chart regarding print.

Next, there will be described on the flow chart of print by the color printer 101 directed to the first embodiment. The ROM 115 stores programs related to the flow charts shown in FIG. 8, FIG. 9 and FIG. 12. The CPU 112 executes the programs at the RAM 116 provided as work area. Firstly, as shown in FIG. 8, in the print process, one line of image data associated with the line head 102B of the thermal head 102 is transferred at S11. Next, temperature of the thermal head 102 is detected by the thermistor 121 at S12. Next, based on the temperature detected at S12, a proper percentage of strobe conduction is selected from a temperature control table at S13. Although not shown, the temperature control table is stored in the ROM 115.

Figure 9:
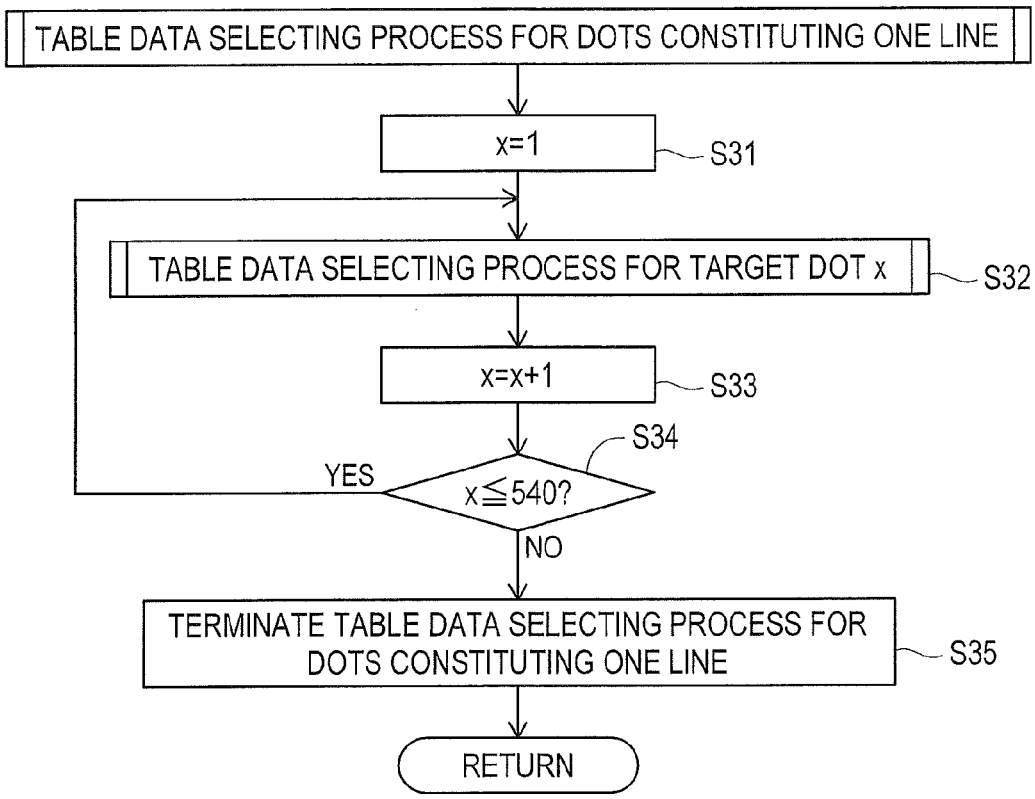
FIG. 9 is a flow chart regarding a table data selecting process for one line.
Figure 12:
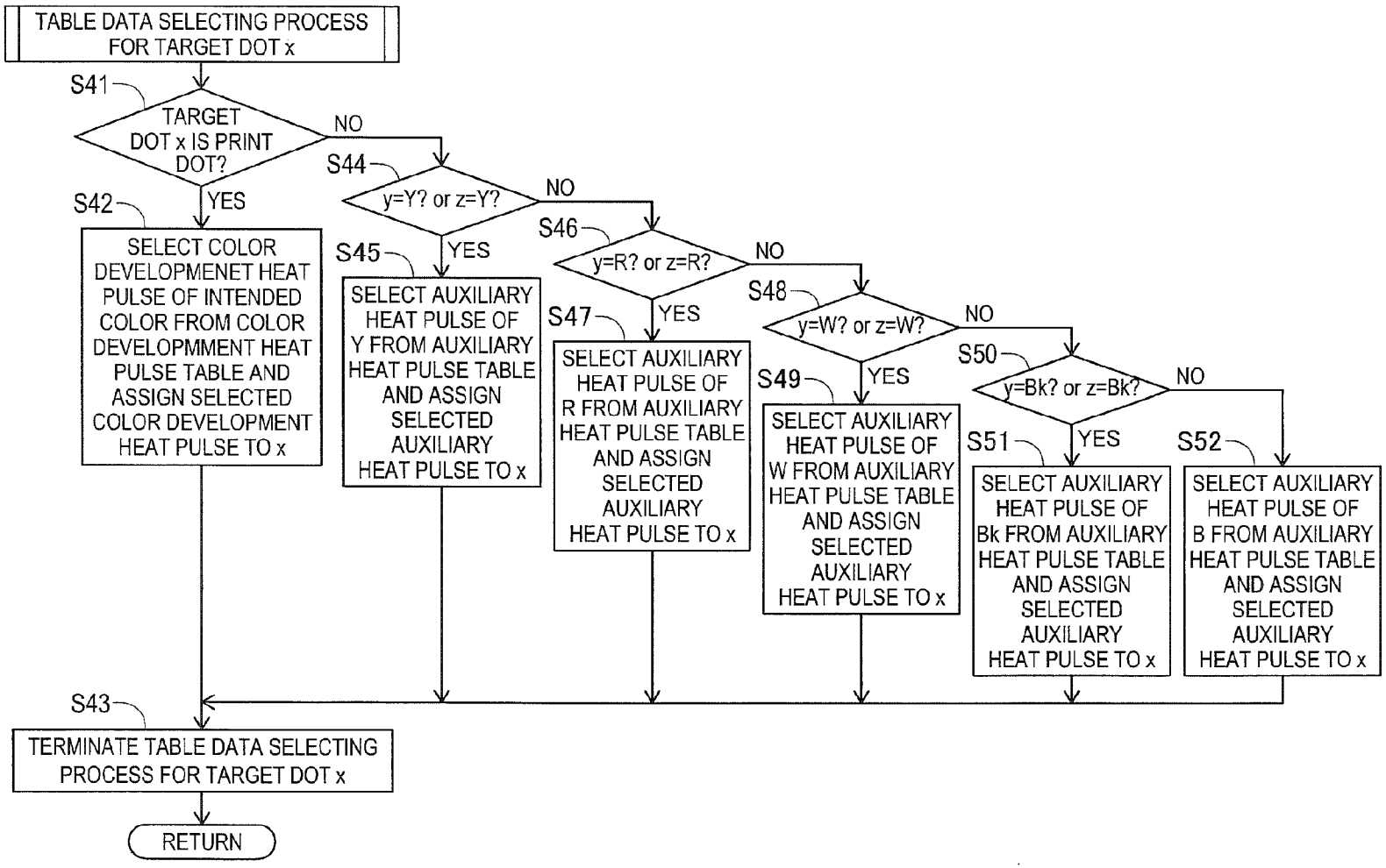
FIG. 12 is a flow chart regarding the table data selecting process for target dot x.

Next, a table data selecting process for dots constituting one line shown in FIG. 9 is carried out at S14. As shown in FIG. 9, "1" is assigned to a variable x at S31. Next, a table data selecting process for target dot x shown in FIG. 12 is carried out at S32. Here will be explained in detail regarding the table data selecting process for target dot x shown in FIG. 12 by referring to a model shown in FIG. 10.

Figure 10:
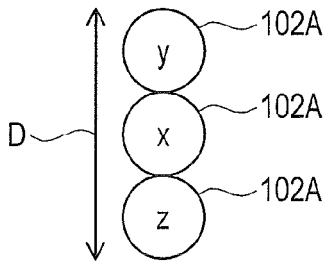
FIG. 10 shows a model of some heat elements in the thermal head for illustrating a table data selecting process for target dot x.

As shown in FIG. 10, a "target dot x" corresponds to one at the middle among three heat elements 102A arranged in the main scanning direction D and the rest of two heat elements 102A at the both sides of the "target dot x" are an "adjoining dot y" and an "adjoining dot z". In a case where a "target dot x" corresponds to a heat element 102A at an end of the line head 102B of the thermal head 102, only one of them, namely, either an "adjoining dot y" or an "adjoining dot z" is present at one side of the "target dot x".

As shown in FIG. 12, in the table data selecting process for target dot x is firstly determined whether or not the "target dot x" is a print dot at S41. The sign "x" of the "target dot x" coincides with a numerical value of a variable x. A print dot corresponds to a heat element 102A serving to get one of the five colors "Y", "R", "B", "W" and "Bk" developed at the color thermosensitive medium 1. It is to be noted that the determination process at S41 is carried out based on the one line of image data transferred at S11 shown in FIG. 8.

In a case where the "target dot x" is a print dot (S41: Yes), the process shifts to S42. At S42, a color development heat pulse for the print dot of the intended color (including color tone level) is selected from the color development heat pulse table (refer to FIG. 6). The value of the selected color development heat pulse is written in a field allocated to the "target dot x" in the data table. Thereafter, the process shifts to S43 so as to terminate the table data selecting process for target dot x and the process shifts to S33 shown in FIG. 9.

In a contrary case where the "target dot x" is not a print dot (S41: No), the process shifts to S44. At S44, it is determined whether or not either the "adjoining dot y" or the "adjoining dot z" is a "Y"-coloring print dot. It is to be noted that the determination process at S44 is carried out based on the one line of image data transferred at S11 shown in FIG. 8.

In a case where either the "adjoining dot y" or the "adjoining dot z" is a "Y"-coloring print dot (S44: Yes), the process shifts to S45. At S45, an auxiliary heat pulse of "Y" for "Y"-coloring print dot is selected from the auxiliary heat pulse table (refer to FIG. 7). The value of the selected auxiliary heat pulse is written in a field allocated to the "target dot x" in the data table. Thereafter, the process shifts to S43 so as to terminate the table data selecting process for target dot x and the process shifts to S33 shown in FIG. 9.

In a contrary case where both the "adjoining dot y" and the "adjoining dot z" are not a "Y"-coloring print dot (S44: No), the process shifts to S46. At S46, it is determined whether or not either the "adjoining dot y" or the "adjoining dot z" is an "R"-coloring print dot. It is to be noted that the determination process at S46 is carried out based on the one line of image data transferred at S11 shown in FIG. 8.

In a case where either the "adjoining dot y" or the "adjoining dot z" is an "R"-coloring print dot (S46: Yes), the process shifts to S47. At S47, an auxiliary heat pulse of "R" for "R"-coloring print dot is selected from the auxiliary heat pulse table (refer to FIG. 7). The value of the selected auxiliary heat pulse is written in a field allocated to the "target dot x" in the data table. Thereafter, the process shifts to S43 so as to terminate the table data selecting process for target dot x and the process shifts to S33 shown in FIG. 9.

In a contrary case where both the "adjoining dot y" and the "adjoining dot z" are not an "R"-coloring print dot (S46: No), the process shifts to S48. At S48, it is determined whether or not either the "adjoining dot y" or the "adjoining dot z" is a "W"-coloring print dot. It is to be noted that the determination process at S48 is carried out based on the one line of image data transferred at S11 shown in FIG. 8.

In a case where either the "adjoining dot y" or the "adjoining dot z" is a "W"-coloring print dot (S48: Yes), the process shifts to S49. At S49, an auxiliary heat pulse of "W" for "W"-coloring print dot is selected from the auxiliary heat pulse table (refer to FIG. 7). The value of the selected auxiliary heat pulse is written in a field allocated to the "target dot x" in the data table. Thereafter, the process shifts to S43 so as to terminate the table data selecting process for target dot x and the process shifts to S33 shown in FIG. 9.

In a contrary case where both the "adjoining dot y" and the "adjoining dot z" are not a "W"-coloring print dot (S48: No), the process shifts to S50. At S50, it is determined whether or not either the "adjoining dot y" or the "adjoining dot z" is a "Bk"-coloring print dot. It is to be noted that the determination process at S50 is carried out based the on one line of image data transferred at S11 shown in FIG. 8.

In a case where either the "adjoining dot y" or the "adjoining dot z" is a "Bk"-coloring print dot (S50: Yes), the process shifts to S51. At S51, an auxiliary heat pulse of "Bk" for "Bk"-coloring print dot is selected from the auxiliary heat pulse table (refer to FIG. 7). The value of the selected auxiliary heat pulse is written in a field allocated to the "target dot x" in the data table. Thereafter, the process shifts to S43 so as to terminate the table data selecting process for target dot x and the process shifts to S33 shown in FIG. 9.

In a contrary case where both the "adjoining dot y" and the "adjoining dot z" are not a "Bk"-coloring print dot (S50: No), the process shifts to S52. At S52, an auxiliary heat pulse of "B" for "B"-coloring print dot is selected from the auxiliary heat pulse table (refer to FIG. 7). The value of the selected auxiliary heat pulse is written in a field allocated to the "target dot x" in the data table. Thereafter, the process shifts to S43 so as to terminate the table data selecting process for target dot x and the process shifts to S33 shown in FIG. 9.

Reverting to FIG. 9, "1" is added to the variable x at S33. Thereafter, the process shifts to S34 at which it is determined whether or not a value of the variable x is under 540. In a case where the variable x is under 540 (S34: Yes), the process returns to S32 so as to carry out the table data selecting process for target dot x.

In a contrary case where the variable x is not under 540 (S34: No), the process shifts to S35 so as to terminate the table data selecting process for dots constituting one line. That is, the table data selecting process for dots constituting one line is to complete a data table which stores either data of color development heat pulse or data of auxiliary heat pulse to be applied to each of the five hundred and forty heat elements 102A constituting the thermal head 102.

Figure 11:
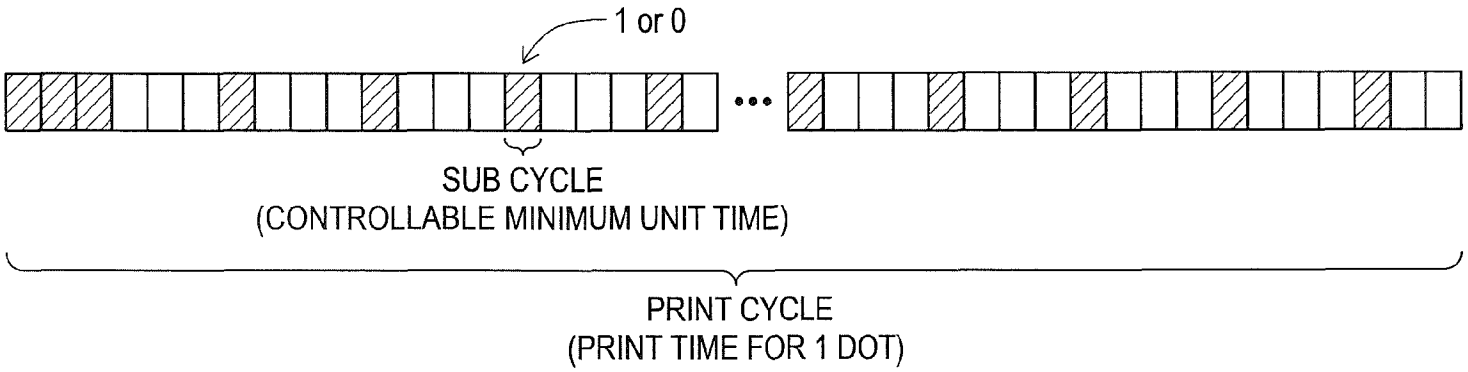
FIG. 11 shows a model of data table for one dot assigned to a heat element.

Thereafter, the process shifts to S15 in FIG. 8. There will be referred to a model shown in FIG. 11 for explaining each of sequential steps S15 through S21. FIG. 11 shows a data table of one dot corresponding to one heat element 102A. As already mentioned, duration of a print cycle is 7000 μs. A sub cycle, a controllable minimum unit time, is 10 μs. Accordingly, in the data table of one dot corresponding to one heat element 102A, there are stored 700 (=7000/10) of binary level data indicated with "1" or "0". As shown in FIG. 8, "1" is assigned to a variable m at S15 and thereafter, "1" is assigned to a variable n at S16. At S17, binary level data relating to an m-th sub cycle of an n-th dot is transferred to the head driving circuit 117. The n-th dot mentioned herein means a heat element 102A at a position associated with a number order corresponding to a value of the variable n among a row of 540 heat elements 102A constituting the line head 102B of the thermal head 102. Data of the m-th sub cycle means a binary level value "1" or "0" to be assigned to a position associated with a number order corresponding to a value of the variable m among a series of 700 sub cycles constituting a data table of one dot (refer to FIG. 11).

At S18, a value of the variable n is incremented by 1. At S19, it is determined whether or not a value of the variable n is under 540. In a case where the value of the variable n is under 540 (S19: Yes), the process returns to S17 and the series of steps to follow S17 is repeated.

In a contrary case where the value of the variable n is not under 540 (S19: No), the process shifts to S20. At S20, a value of the variable m is incremented by 1. At S21, it is determined whether or not a value of the variable m is under 700. In a case where the value of the variable m is under 700 (S21: Yes), the process returns to S16 and the series of steps to follow S16 is repeated.

In a contrary case where the value of the variable m is not under 700 (S21: No), the process shifts to S22. At S22, the head driving circuit 117 is controlled to perform latch, strobe and heating so as to terminate multicolor print for one line of image data (S23). By thus repeating each step indicated in the flow charts shown in FIG. 8, FIG. 9 and FIG. 12 by the number of times corresponding to the number of lines constituting image data, multicolor print of the image data finishes.

1-5. Summary

In the color printer 101 and the method for controlling heat pulse of the color printer 101 directed to the first embodiment, a color image gets developed at a color thermosensitive medium 1 in a manner of one-pass operation so that the printing medium 1 is conveyed only once in one direction in contact with the thermal head 102 consisting of plural heat elements 102A. When seen from the side of the thermal heat 102 in contact with the color thermosensitive medium 1, on the base material 2, the cyan coloring layer 3, the magnet coloring layer 4 and the yellow coloring layer 5 are laminated in this order.

In this connection, each of the cyan, magenta and yellow coloring layers 3, 4 and 5 has its own color development properties. The cyan coloring layer 3 is an uppermost coloring layer facing the thermal head 102 when the color thermosensitive medium 1 is conveyed, so that cyan starts coloring up relatively in a shorter period of time at higher temperature. The yellow coloring layer 5 is a bottommost coloring layer farthest from the thermal head 102 when the color thermosensitive medium 1 is conveyed, so that yellow starts coloring up relatively in a longer period of time at lower temperature. The magenta coloring layer 4 is a middle coloring layer between the uppermost and bottommost coloring layers, so that magenta starts coloring up in a medial period of time at medial temperature in comparison with the uppermost and bottommost coloring layers.

That is, each of the cyan, magenta and yellow coloring layers 3, 4 and 5 has its own color development temperature. Color development temperature of the yellow coloring layer 5 put as bottommost coloring layer is lower than that of the magenta coloring layer 4 put as middle coloring layer. Color development temperature of the magenta coloring layer 4 is lower than that of the cyan coloring layer 3 put as uppermost coloring layer. For color development of the yellow coloring layer 5 as bottommost coloring layer, it is required that duration to heat the yellow coloring layer 5 be made longer than duration to heat the magenta coloring layer 4 as middle coloring layer. For color development of the magenta coloring layer 4 as middle coloring layer, it is required that duration to heat the magenta coloring layer 4 be made longer than duration to heat the cyan coloring layer 3 as the uppermost coloring layer.

All of the heat elements 102A of the thermal head 102 are functionally distinguished between "coloring heat elements" serving to color development at the color thermosensitive medium 1 and "non-printing heat elements" not serving to color development when getting color development at the color thermosensitive medium 1.

When a color development heat pulse for one dot of an intended image is applied to each "coloring heat element"

among heat elements 102A constituting the thermal head 102, an auxiliary heat pulse which is not so hot as the extent of causing color development at the color thermosensitive medium 1 is applied to each "non-printing heat element" adjoining to the "coloring heat element" with reference to the main scanning direction D of the thermal head 102.

That is, absence or presence of a "non-printing heat element" which adjoins to a "coloring heat element" with reference to the main scanning direction D of the thermal head 102 brings influence on temperature level the "coloring heat element" is allowed to reach when color development heat is applied. Since influence on temperature level brought to the "coloring heat element" differs depending on color to get developed at the multicolor thermosensitve medium 1 by the said "coloring heat element", there is applied to the "non-printing heat element" an auxiliary heat pulse appropriate to the intended color to get developed by the said "coloring heat element".

Thereby, when color development heat of an intended color is applied to the "coloring heat element" for multicolor print on the multicolor thermosensitve medium 1 with thermal head 102 in accordance with one-pass operation, auxiliary heat temperature level of which is appropriate to the intended color is applied to the "non-printing heat element" adjoining to the said "coloring heat element" with reference to the main canning direction D of the thermal head 102.

Thereby, in the color printer 101 and the method for controlling heat pulse of color printer 101 directed to the first embodiment, improvement can be achieved on color development properties of multicolor print performed on the color thermosensitive medium 1 by using the thermal head 102 in one-pass operation.

According to the color printer 101 and the method for controlling heat pulse of the color printer 101 directed to the first embodiment, in a case of coloring up "B" or "Bk", for instance, there is necessity to color up the cyan coloring layer 3 at the uppermost position when seen from the side of thermal head 102 in contact with the color thermosensitive medium 1. In this connection, the cyan coloring layer 3 starts coloring up relatively in a shorter period time at higher temperature.

Therefore, there is necessity to give high heat to the color thermosensitive medium 1 by applying color development pulse having high amount of energy to a heat element 102A distinguished as "coloring heat element" at once.

In that case, heat temperature given to the "coloring heat element" is high. Therefore, in a case where it gets high with respect to amount of energy for an auxiliary heat pulse to be given to a heat element 102A distinguished as a "non-printing heat element" that adjoins to a "coloring heat element" in the main scanning direction D of the thermal head 102, the "non-printing heat element" may get a color developed at the multicolor thermosensitve medium 1.

For that reason, a comparatively small amount of energy is set with respect to an auxiliary heat pulse to be applied to a "non-printing heat element" that adjoins to the "coloring heat element" for "B" or "Bk" with reference to the main scanning direction D of the thermal head 102 (refer to FIG. 7).

Accordingly, in the color printer 101 and the method for controlling heat pulse of the color printer 101 directed to the first embodiment, the former is larger than the latter between the followings: an amount of energy for one dot of an auxiliary heat pulse to be given to a "non-printing heat element" adjoining to a "coloring heat element" for a color that get developed without coloring up of the cyan coloring layer 3 in the main scanning direction D; and an amount of energy for one dot of an auxiliary heat pulse to be given to a "non-printing heat element" adjoining to a "coloring heat element" for a color that get developed by coloring up the cyan coloring layer 3 in the main scanning direction D.

Thereby, in the color printer 101 and the method for controlling heat pulse of the color printer 101 directed to the first embodiment, improvement can be achieved on color development properties of multicolor print performed on the color thermosensitive medium 1 by using the thermal head 102 in one-pass operation.

According to the color printer 101 and the method for controlling heat pulse of the color printer 101 directed to the first embodiment, a color development heat pulse for one dot of an intended image is applied to a "coloring heat element" among heat elements 102A constituting the thermal head 102. At the same time, an auxiliary heat pulse is applied to a "non-printing heat element" adjoining to the "coloring heat element" with reference to the main scanning direction D of the thermal head 102, wherein the auxiliary heat pulse applied thereto is the one appropriate to the color the "coloring heat element" intends to get developed at the color thermosensitive medium 1.

Figure 13A:
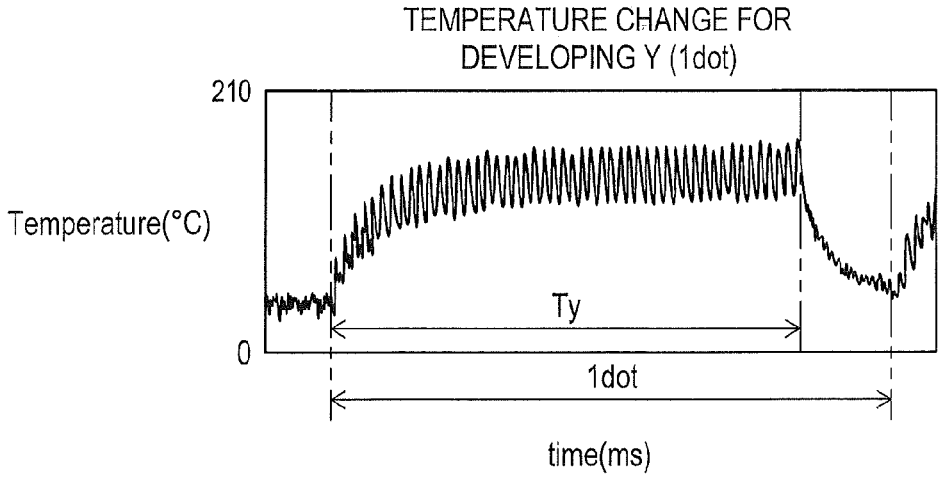
FIG. 13A shows an application pattern of color development heat pulse, which develops one dot of an intended image into Y (yellow) color, by time axis and temperature axis.

For instance, FIG. 13A shows an application pattern of color development heat pulse for developing one dot of color-"Y" image expressed in line with time axis and temperature axis. In FIG. 13A, a time Ty corresponds to the color development heat pulse application duration for "Y". During the time Ty, a "non-printing heat element" adjoining to the "coloring heat element" for "Y" with reference to the main scanning direction of the thermal head 102 is recognized as a target heat element 102A. The target heat element 102A is a heat element to receive an auxiliary heat pulse that helps the "coloring heat element" for "Y" to get the intended color developed at the color thermosensitive medium 1.

Figure 13B:
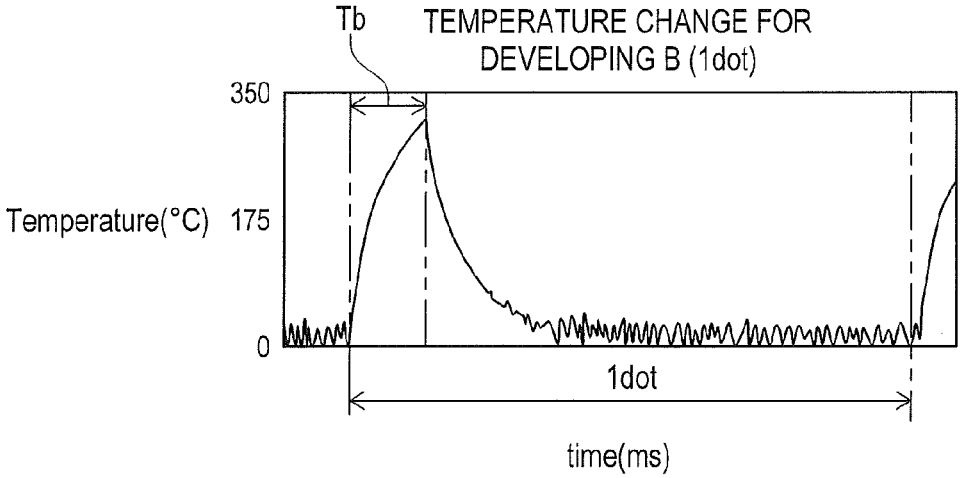
FIG. 13B shows an application pattern of color development heat pulse, which develops one dot of an intended image into B (blue) color, by time axis and temperature axis.

Further, FIG. 13B shows an application pattern of color development heat pulse for developing one dot of color-"B" image expressed in line with time axis and temperature axis. In FIG. 13B, a time Tb corresponds to the color development heat pulse application duration for "B". During the time Tb, a "non-printing heat element" adjoining to the "coloring heat element" for "B" with reference to the main scanning direction of the thermal head 102 is recognized as a target heat element 102A. The target heat element 102A is a heat element to receive an auxiliary heat pulse that helps the "coloring heat element" for "B" to get the intended color developed at the color thermosensitive medium 1.

Thereby, in the color printer 101 and the method for controlling heat pulse of color printer 101 directed to the first embodiment, improvement can be achieved on color development properties of multicolor print performed on the color thermosensitive medium 1 by using the thermal head 102 in one-pass operation.

According to the color printer 101 and the method for controlling heat pulse of the color printer 101 directed to the first embodiment, various auxiliary heat pulses are defined as shown in FIG. 7. That is, each auxiliary heat pulse is defined by length of a chopper control period (cycle) and a ratio (duty cycle) of ON-time and OFF-time (in the chopper control period), and applied to a heat element 102A distinguished as a "non-printing heat element".

Since various auxiliary heat pulses are thus defined, temperature of a "non-printing heat element" to which an auxiliary heat pulse is applied can be set to temperature appropriate to a color to get developed at the thermosensitve medium 1 by a "coloring heat element" adjoining to the said "non-printing heat element" with reference to the main scanning direction D of the thermal head 102.

Thereby, in the color printer 101 and the method for controlling heat pulse of color printer 101 directed to the first embodiment, improvement can be achieved on color development properties of multicolor print performed on the color thermosensitive medium 1 by using the thermal head 102 in one-pass operation.

2. Second Embodiment

Next, there will be described on a color printer and a method for controlling heat pulse of the color printer directed to the second embodiment.

2-1. Color Printer

The color printer and the method for controlling heat pulse of the color printer directed to the second embodiment are the same as the color printer 101 and the method for controlling heat pulse of the color printer 101 directed to the first embodiment. Accordingly, there will be omitted details about the color printer and flow charts thereof while there will be used numerical signs and step numbers the same as those used for describing the color printer 101 and the flow charts directed to the first embodiment.

2-2. Color Thermosensitive Medium

Figure 14:
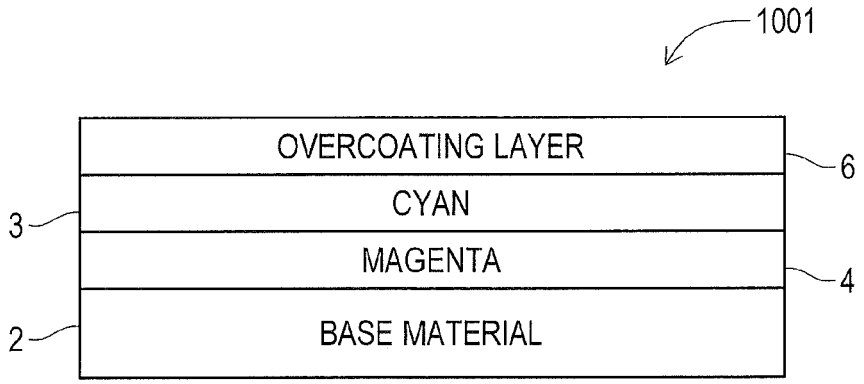
FIG. 14 is a cross-sectional view of a color thermosensitive medium used by the color printer directed to the second embodiment.

In the second embodiment, the color printer 101 uses a color thermosensitive medium 1001 illustrated in FIG. 14 instead of the color thermosensitive medium 1 illustrated in FIG. 3. As to the color thermosensitive medium 1001 of the second embodiment, constituting elements the same as those of the color thermosensitive medium 1 are referred by using the numerical signs the same as those in the first embodiment.

As illustrated in FIG. 14, the color thermosensitive medium 1001 includes a white-colored base material 2. On the base material 2, magenta and cyan coloring layers 4, 3 are laminated in this order. An overcoating layer 6 is laminated on the cyan coloring layer 3. At the timed of multicolor print, the color thermosensitive medium 1001 is conveyed in only one direction by the platen roller 103 in a state of being held between the thermal head 102 and the platen roller 103. While being conveyed in the state of being held between the thermal head 102 and the platen roller 103, the thermosensitive medium 1001 is pressed against the thermal head 102 by the platen roller 103.

Of the color thermosensitive medium 1001, the side of the overcoating layer 6 laid over the cyan coloring layer 3 is pressed against the thermal head 102. That is, when seen from the side of the thermal head 102 in contact with the color thermosensitive medium 1001, the ovrcoating layer 6 is put closest and the cyan coloring layer 3, the magenta coloring layer 4 and the base material 2 are put even farther therefrom in this order.

The thermal head 102 generates color development heat which is heat energy for color development at the color thermosensitive medium 1001. The thermal head 102 also generates auxiliary heat which is heat energy not so hot as the extent of causing color development at the color thermosensitive medium 1001. As already described, of the color thermosensitive medium 1001, the overcoating layer 6 laid over the cyan coloring layer 3 is pressed against the thermal head 102. Therefore, heat energy (color development heat and auxiliary heat) generated by the thermal head 102 is given to the color thermosensitive medium 1001 from the side of the overcoating layer 6 laminated over the cyan coloring layer 3. At the time of multicolor print, the control unit 111 and the head driving circuit 117 control the thermal head 102 for proper color development at the color thermosensitive medium 1001 in accordance with respective color development properties of the cyan and magenta coloring layers 3 and 4.

The control unit 111 and the head driving circuit 117 control duration of drive voltage application to the thermal head 102 and drive voltage application timing in a print cycle (7000 μs, in the embodiment). Thereby, regarding each heat element 102A of the thermal head 102, a set of heat temperature and heat duration is controlled by selectively using two kinds of heat, namely, between color development heat and auxiliary heat depending on respective color development properties of the cyan and magenta coloring layers 3 and 4 which are to get developed at the color thermosensitive medium 1001.

Incidentally, all the heat elements 102A of the thermal head 102 for multicolor print are functionally distinguished between "coloring heat elements" and "non-printing heat elements". More specifically, in the thermal head 102, the coloring heat elements are heat elements subject to receiving color development heat which is heat energy for color development at the color thermosensitive medium 1001 while the non-printing heat elements are heat elements subject to receiving auxiliary heat. That is, auxiliary heat is given to a heat element 102A distinguished as a "non-printing heat element" which adjoins to a heat element 102A distinguished as a "coloring heat element", with reference to the main scanning direction D of the thermal head 102.

That is, depending on respective coloring properties of the cyan and magenta coloring layers 3 and 4 which are to get developed at the color thermosensitive medium 1001, the control unit 111 and the head driving circuit 117 selectively apply color development heat pulses to "coloring heat elements" among the heat elements 102A while applying auxiliary heat pulses to "non-printing heat elements" adjoining to "coloring heat elements" with reference to the main scanning direction D of the thermal head 102. Incidentally, hatching for distinctively indicating cross-sections of the base material 2, the cyan and magenta coloring layers 3 and 4 and the overcoating layer 6 is omitted in FIG. 14 for the purpose of avoiding too many lines disturbing view of the color thermosensitive medium 1.

2-3. Summary

In the color printer and the method for controlling heat pulse of the color printer directed to the second embodiment, the color thermosensitive medium 1001 as shown in FIG. 14 is used. Otherwise, the second embodiment brings working effect the same as the working effect brought by the color printer and the method for controlling heat pulse of the color printer directed to the first embodiment.

3. Other

It is to be noted that the disclosure is not restricted to aspects directed to the present embodiment and that various changes and modification may be made without departing from the gist of the disclosure.

While presently exemplary embodiments have been shown and described, it is to be understood that this disclosure is for the purpose of illustration and various changes and modifications may be made without departing from the scope of the disclosure as set forth in the appended claims.

What is claimed is:

1. A color printer comprising:

a thermal head including a plurality of heat elements;

a platen roller configured to convey a color thermosensitive medium only once through the thermal head, the color thermosensitive medium including a base material and two or more coloring layers laminated on the base material and the platen roller being configured to convey the color thermosensitive medium such that, of the base material and the two or more coloring layers, the base material is disposed farthest from the thermal head and a topmost one of the coloring layers is disposed closest to the thermal head; and a control unit configured to control the thermal head and the platen roller, the control unit being further configured to perform:

distinguishing each of the plurality of heat elements as one of: a coloring heat element and a non-print heat element, wherein each coloring heat element is configured for performing color development of one dot of an intended image at the color thermosensitive medium and wherein each non-print heat element is configured for withholding color development at the color thermosensitive medium;

setting a color development heat pulse for each coloring heat element, each color development heat pulse having a color development temperature and a color development heat duration, wherein each color development temperature and color development heat duration is set based on a color of the one dot of the intended image at the thermosensitive medium, and wherein a color associated with development of a coloring layer farther from the base material has a higher color development temperature and a lower color development heat duration than a color associated with development of a coloring layer closer to the base material; and setting an auxiliary heat pulse for each non-printing heat element that adjoins a coloring heat element in a scanning direction of the thermal head, wherein each auxiliary heat pulse is set based on a color of the adjoining coloring heat element.

2. The color printer according to claim 1, wherein the control unit is configured to simultaneously perform setting the color development heat pulse for each coloring heat element and setting the auxiliary heat pulse for each non-printing heat element that adjoins a coloring heat element in the scanning direction of the thermal head.

3. The color printer according to claim 1, wherein each auxiliary heat pulse is defined by length of a chopper control period and a ratio of ON-time and OFF-time in the chopper control period.

4. The color printer according to claim 3, wherein the length of the chopper control period and the ratio of ON-time and OFF-time in the chopper control period are selected based on the color of the adjoining coloring heat element.

5. The color printer according to claim 4, wherein the length of the chopper control period is lower for an auxiliary heat pulse associated with a color having a coloring layer closer to the base material than an auxiliary heat pulse associated with a color having a coloring layer farther from the base material.

6. The color printer according to claim 4, wherein the ratio of ON-time and OFF-time in the chopper control period is higher for an auxiliary heat pulse associated with a color having a coloring layer closer to the base material than an auxiliary heat pulse associated with a color having a coloring layer farther from the base material.

7. The color printer according to claim 1, wherein a first amount of energy of an auxiliary heat pulse for a non-printing heat element adjoining a coloring heat element that develops a color associated with a lower coloring layer with reference to the base material is larger than a second amount of energy of an auxiliary heat pulse for a non-printing heat element adjoining a coloring heat element that develops a color associated with an upper coloring layer with reference to the base material.

8. The color printer according to claim 1, wherein the color thermosensitive medium includes three coloring layers, an uppermost layer being a first coloring layer, a middle layer being a second coloring layer and a bottommost layer being a third coloring layer.

9. The color printer according to claim 1, wherein the auxiliary heat pulse for each non-printing heat element that adjoins a coloring heat element has a temperature and a heat duration, and wherein each temperature and heat duration is set based on a color of the one dot associated with the adjoining coloring heat element.

10. The color printer according to claim 9, wherein a temperature of an auxiliary heat pulse for a non-printing heat element adjoining a coloring heat element that develops a color associated with a coloring layer closer to the base material is higher than a temperature of an auxiliary heat pulse for a non-printing heat element adjoining a coloring heat element that develops a color associated with having a coloring layer farther from the base material.

11. The color printer according to claim 1, wherein an auxiliary heat pulse to be applied to a non-printing heat element is further set based on a color selection priority, and wherein a color associated with a coloring layer closer to the base material has a higher color selection priority than a coloring layer farther from the base material.

12. The color printing according to claim 1, wherein an auxiliary heat pulse to be applied to a non-printing heat element is further set based on an auxiliary heat pulse table.

13. A color thermosensitive medium and a color printer, wherein the color thermosensitive medium comprises:

a base material; and two or more coloring layers laminated on the base material, wherein a color associated with a coloring layer farther from the base material has a higher color development temperature and a lower color development heat duration than a color associated with a coloring layer closer to the base material, and wherein the color printer comprises:

a thermal head including a plurality of heat elements;

a platen roller configured to convey a color thermosensitive medium only once through the thermal head, the platen roller being configured to convey the color thermosensitive medium such that, of the base material and the two or more coloring layers, the base material is disposed farthest from the thermal head and a topmost one of the coloring layers is disposed closest to the thermal head; and a control unit configured to control the thermal head and the platen roller, the control unit being further configured to perform:

distinguishing each of the plurality of heat element as one of: a coloring heat element and a non-print heat element, wherein each coloring heat element is configured for performing color development of one dot of an intended image at the color thermosensitive medium and wherein each non-print heat element is configured for withholding color development at the color thermosensitive medium;

setting a color development heat pulse for each coloring heat element, each color development heat pulse having a color development temperature and a color development heat duration, wherein each color development temperature and color development heat duration is set based on a color of the one dot of the intended image at the thermosensitive medium; and setting an auxiliary heat pulse for each non-printing heat element that adjoins a coloring heat element in a scanning direction of the thermal head, wherein each auxiliary heat pulse is set based on a color of the adjoining coloring heat element.

* * * * *